United States Patent [19]

Bourdeau

[11] Patent Number: 4,635,382

[45] Date of Patent: Jan. 13, 1987

[54] CORDLESS HAND HELD HOT AIR HAIR DRYER

[76] Inventor: Serge Bourdeau, 104 Meaney, Kirkland, Quebec, Canada, H8T 3B5

[21] Appl. No.: 838,246

[22] Filed: Mar. 10, 1986

[51] Int. Cl.[4] ..... A45D 2/00

[52] U.S. Cl. ..... 34/97; 34/30; 34/52; 132/9; 431/256; 431/328; 431/344; 126/401; 126/409

[58] Field of Search ..... 126/401, 408, 409, 208, 126/161 R, 204; 34/26, 30, 97, 90, 96, 3, 58, 52; 431/253, 256, 326, 328, 329, 344; 432/222, 58, 92; 132/118, 9

[56] References Cited

U.S. PATENT DOCUMENTS

| | | | |
|---|---|---|---|
| 3,509,866 | 5/1970 | Singleton | 126/208 X |
| 4,198,557 | 4/1980 | Crowley | 34/97 X |
| 4,502,465 | 3/1985 | Yoshinaga et al. | 431/256 X |
| 4,555,232 | 11/1985 | Raccah et al. | 34/97 |

*Primary Examiner*—Randall L. Green

*Attorney, Agent, or Firm*—Swabey, Mitchell, Houle, Marcoux & Sher

[57] ABSTRACT

A cordless hand held hot air hair dryer comprises a nozzle for exhausting air, a heating chamber disposed proximate the nozzle, a fuel reservoir for storing a vaporizable fuel in a liquid state, and catalytic heating means in fluid flow communication with the fuel reservoir and including a catalyst member disposed within the heating chamber for combusting vaporized fuel supplied from the fuel reservoir. The dryer further includes a battery-powered motor and a fan driven by the motor for passing air through the heating chamber so as to contact said catalyst member, to thereby heat the air prior to exhausting through the nozzle. Manually operated control means are also provided for controlling the amount of current applied to the motor and proportionally adjusting the flow of fuel to the heating means to thereby regulate the temperature of the heated air in relation to the amount of air flow exhausted through the nozzle.

18 Claims, 9 Drawing Figures

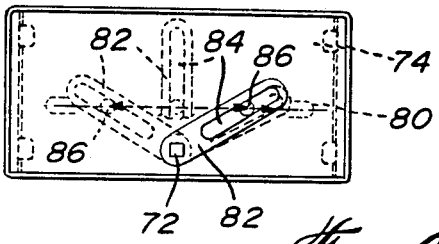
Fig. 4
Fig. 8
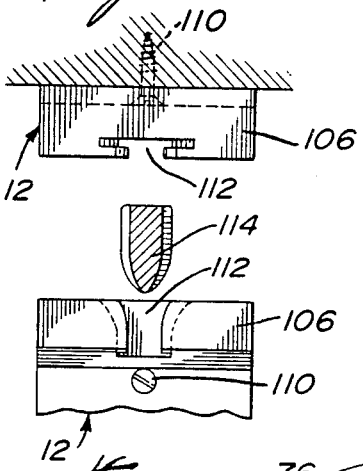
Fig. 9
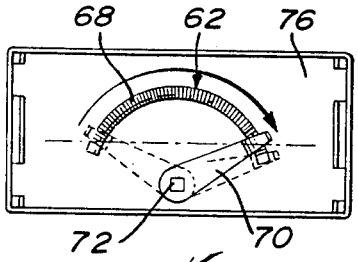
Fig. 5
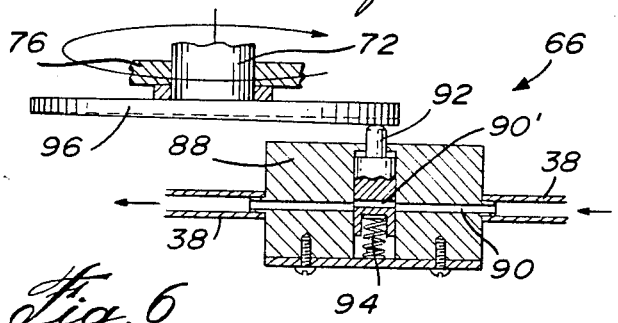
Fig. 6
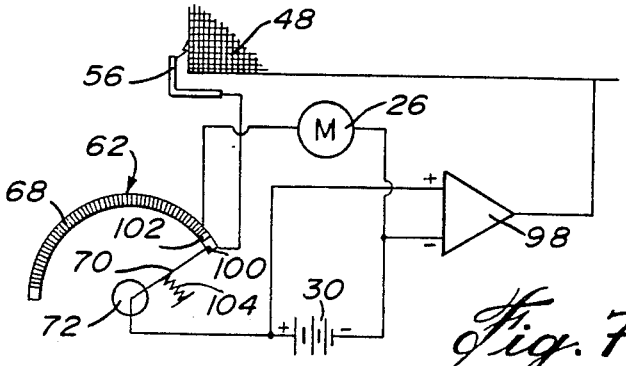
Fig. 7

CORDLESS HAND HELD HOT AIR HAIR DRYER

BACKGROUND OF THE INVENTION

The present invention relates to improvements in hair dryers. More particularly, the invention is concerned with an improved hand held hot air hair dryer which does not require electrical connection to an AC external source for operation.

A conventional hand held hot air hair dryer usually comprises a nozzle for exhausting air, a heating chamber disposed proximate the nozzle and containing electrical heater coils, and a motor-driven fan for passing air through the heating chamber to thereby heat the air prior to exhausting through the nozzle. Two independent electrical switches are generally used, one for varying the power supplied to the heater coils so as to vary the temperature of the heated air and the other for varying the speed of the motor so as to vary the velocity of the air flow exiting the nozzle. Such a hair dryer must necessarily be connected to an AC external source by means of an electrical wire for powering both the motor and heater, the power requirement of the latter being in the range of about 600 to about 1200 watts. The hair dryer is therefore limited in use since it can only be operated where there is an AC external source available for providing the necessary electrical power. Moreover, the electrical wire which serves to connect the hair dryer to the AC external source is annoying and usually hinders the movement of the operator's hand holding the hair dryer.

SUMMARY OF THE INVENTION

It is therefore an object of the present invention to overcome the above drawbacks and to provide a wireless hand held hot air hair dryer.

In accordance with one aspect of the invention, there is provided a wireless hand held hot air hair dryer comprising nozzle means for exhausting air, a heating chamber disposed proximate the nozzle means, fuel supply means for storing a vaporizable fuel in a liquid state, and catalytic heating means in fluid flow communication with the fuel supply means and including a catalyst member disposed within the heating chamber for combusting vaporized fuel supplied from the fuel supply means. The hair dryer of the invention further includes battery-powered motor means and fan means driven by the motor means for passing air through the heating chamber so as to contact the catalyst member, to thereby heat the air prior to exhausting through the nozzle means. Manually operated control means are also provided for controlling the amount of current applied to the motor means and proportionally adjusting the flow of fuel to the heating means to thereby regulate the temperature of the heated air in relation to the amount of air flow exhausted through the nozzle means.

According to a preferred embodiment of the invention, the motor means is powered by rechargeable battery means connected thereto. Preferably, the hair dryer further includes AC-DC converter/transformer means coupled to the battery means for recharging same.

By the expression "cordless hand held hot air hair dryer" as herein employed is meant a hand held hot air hair dryer which does not require electrical connection to an AC external source for operation, apart from that required for recharging the battery means where rechargeable battery means are used.

In a preferred construction, the hair dryer comprises a housing having a central portion in which the motor means and fan means are mounted, a tubular portion extending forwardly of the central portion and defining the heating chamber with the nozzle means being provided at a free end of the tubular portion, and a handle portion depending from the central portion in which the control means, battery means and AC-DC converter/-transformer means are mounted. The fuel supply means comprises a pressure vessel arranged rearwardly of the central portion and defining a reservoir for containing the fuel, the pressure vessel having a bottom wall provided with a refill valve for refilling the reservoir with fuel. This arrangement is particularly advantageous since it enables the hair dryer to be recharged with electricity and refilled with fuel by means of a combined electric and fuel recharging unit which the present invention further provides.

Thus, the present invention also provides, in a further aspect thereof, a combined electric and fuel recharging unit for use in recharging a hair dryer as described just above with electricity and refilling same with fuel, comprising means for supporting and retaining the dryer in an upright position while allowing free vertical displacement thereof, means for holding a fuel container having at an upper end thereof a fuel discharge valve in an upright position with the fuel discharge valve positioned in alignment with the refill valve of the dryer, electrical female plug means engageable with electrical male plug means housed in the handle portion of the dryer and connected to the AC-DC converter/transformer means for supplying same with electricity, the electrical female plug means being mounted for limited vertical displacement thereof between upper and lower positions, and spring means upwardly biasing the electrical female plug means to the upper position. The hair dryer is conveniently recharged with electricity and refilled with fuel by downwardly displacing the dryer to a recharge and refill position causing electrical connection between the electrical male and female plug means and engagement of the refill valve with the fuel discharge valve and by maintaining the dryer at the recharge and refill position against the upward force exerted by the spring means for a period of time sufficient to allow the reservoir of the dryer to be refilled with fuel. Upon release of the dryer, the electrical female plug means is upwardly moved by the spring means from the lower position to the upper position to upwardly displace the dryer and thereby cause disengagement of the refill valve and the fuel discharge valve from one another while maintaining the electrical connection between the electrical male and female plug means. In this manner, the battery means is maintained charged while accidental leakage between the refill valve and fuel discharge valve, which otherwise could occur if the valves remained engaged, is prevented.

According to a particularly preferred embodiment of the hair dryer of the invention, the control means are actuated by a single manually operable actuator member. To this end, a conduit means interconnects the fuel supply means with the heating means and the control means include valve means in the conduit means for varying the flow of fuel to the heating means and variable resistor means connected intermediate the battery means and the motor means for varying the amount of current applied to the motor means, the actuator member being operatively connected to both the valve means and variable resistor means for actuating same. Preferably, the actuator member is continuously movable along a rectilinear path between first and second limit positions whereby to increase the amount of current applied to the motor means when the actuator member is moved in a direction toward the second limit position or to decrease the amount of current when the actuator member is moved in a direction toward the first limit position while correspondingly increasing or decreasing the flow of fuel to the heating means to thereby provide heated air having a substantially constant temperature independently of the amount of air flow exhausted through the nozzle means.

The variable resistor means preferably comprises a rheostat having an elongated resistor element and an electrically conductive sweeping arm in frictional sliding engagement with the resistor element for sweeping same, the arm being fixedly connected to a rotatably mounted shaft for permitting the arm to sweep the resistor element when the shaft is rotated. The actuator member is connected to the shaft by connecting means adapted to convert the translational movement of the actuator member into a rotational movement for rotating the shaft.

The valve means, on the other hand, preferably comprises a valve body having a fuel passageway formed therein and a valve stem movable in the valve body to adjustably restrict the fuel passageway. A cam disk is fixedly mounted to the shaft and frictionally engages the stem for moving same when the shaft is rotated in response to a displacement of the actuator member.

BRIEF DESCRIPTION OF THE DRAWINGS

Further features and advantages of the invention will become more readily apparent from the following description of preferred embodiments thereof as illustrated by way of examples in the accompanying drawings, in which:

FIG. 4 is a sectional view taken along line 4—4 of FIG. 3;

FIG. 5 is a sectional view taken along line 5—5 of FIG. 3;

FIG. 6 is a fragmentary part-sectional view illustrating the valve component of the control means shown in FIG. 3;

FIG. 7 is a schematic diagram illustrating the circuit used for varying the amount of current applied to the motor driving the fan of the hair dryer shown in FIG. 1;

FIG. 8 is a fragmentary part-sectional view taken along line 8—8 of FIG. 1; and FIG. 9 is a fragmentary sectional view taken along line 9—9 of FIG. 1

DESCRIPTION OF PREFERRED EMBODIMENTS

Figures 1, 2, 3:
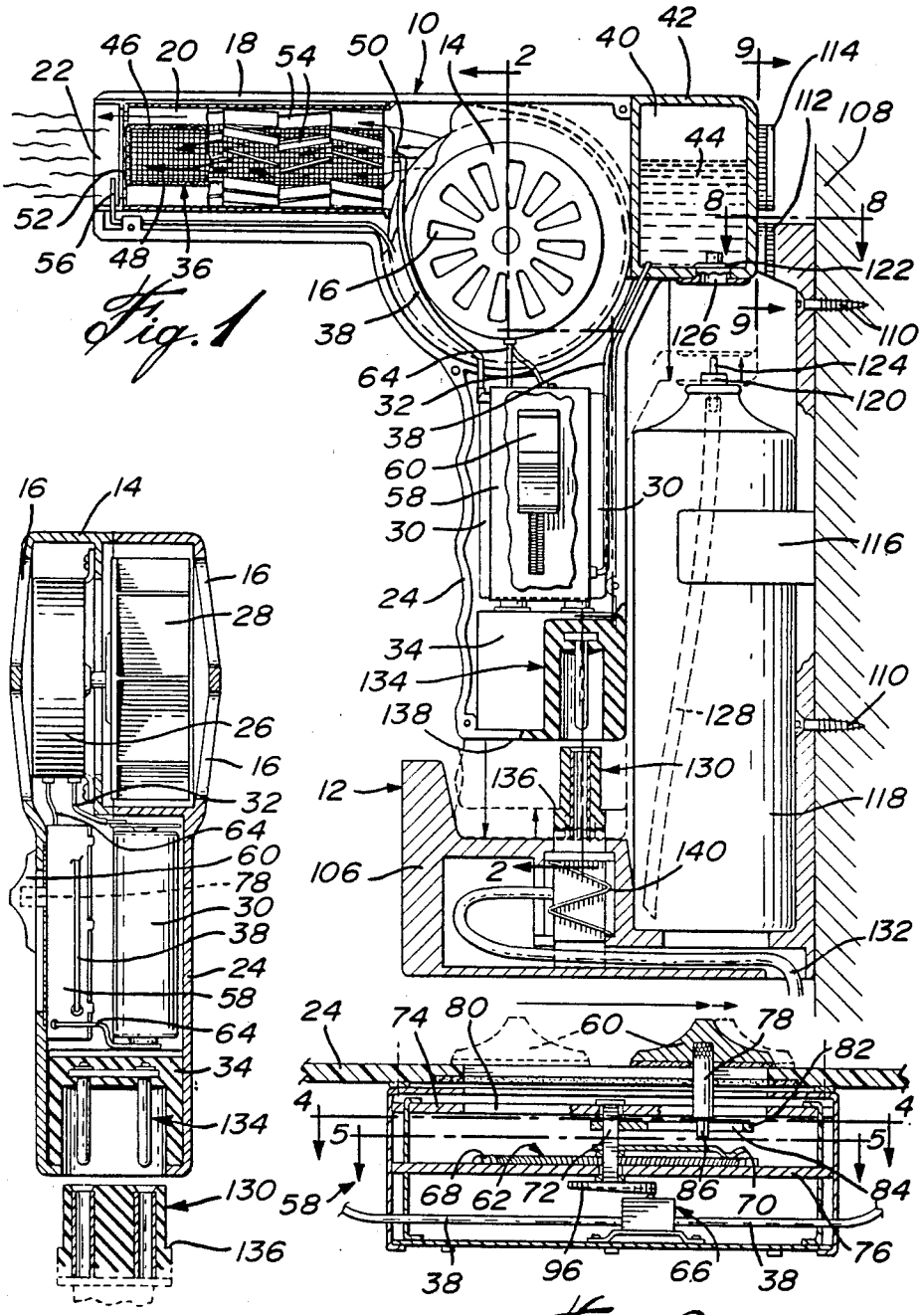
FIG. 1 is a part-sectional view of a cordless hand held hot air hair dryer according to the invention, seen installed on a combined electric and fuel recharging unit for recharging the dryer with electricity and refilling same with fuel.
FIG. 2 is a sectional view taken along line 2—2 of FIG. 1.
FIG. 3 is a fragmentary part-sectional view illustrating the control means of the hair dryer shown in FIG. 1.

Referring first to FIG. 1, there is illustrated a cordless hand held hot air hair dryer generally designated by reference numeral 10 and seen installed on a combined electric and fuel recharging unit 12. The hair dryer 10 comprises a housing having a central portion 14 formed with side openings 16 for admitting air, a tubular portion 18 extending forwardly of the central portion 14 and defining an inner heating chamber 20 and an end nozzle 22 for exhausting air, and a handle portion 24 depending from the central portion 14. Mounted inside the central portion are a motor 26 and a fan 28 driven by the motor 26 for passing the air through the heating chamber 20, the motor 26 being powered by a rechargeable battery 30 mounted in the handle portion 24 and connected to the motor 26 by the electrical wire 32, as best shown in FIG. 2. An AC-DC converter/transformer 34 also mounted in the handle portion 24 is coupled to the battery 30 for recharging same, the AC-DC converter/transformer 34 being operative to convert AC current supplied from an AC household power source to DC current and to lower the voltage from normal household voltage to the operating voltage of the battery 30.

The heating chamber 20 contains a hollow cylindrical catalytic heater 36 extending coaxially with the tubular portion 18 of the dryer housing for heating the air blown by the fan 28 prior to exhausting through the nozzle 22. A conduit 38 interconnects the catalytic heater 36 with a fuel reservoir 40 defined in a pressure vessel 42 arranged rearwardly of the central portion 14. The reservoir 40 is adapted to contain vaporizable fuel 44 in a liquid state, such as butane. The catalytic heater 36 comprises a catalyst member 46 provided with an outer metallic screen 48 supporting the latter inside the heating chamber 20, the catalyst member 46 being formed for instance of asbestos and platinum or palladium to combust the fuel 44 supplied from the reservoir 40 via the conduit 38 and vaporized inside the catalytic heater 36 by means of the vaporizing nozzle 50. Since the catalytic heater 36 is closed at its outer end by the catalyst member 46 and metallic screen 48 except for a small aperture 52, the vaporized fuel is forced through the catalyst member 46 to realize efficient burning. A plurality of baffle elements 54 are provided inside the heating chamber 20 for directing the air blown by the fan 28 onto the catalytic heater 36 and increasing the residence time of the air inside the heating chamber 20. An electrical ignition system is also provided for initiating the combustion of the vaporized fuel, which includes a pair of electrodes of opposite polarity with one electrode 56 disposed adjacent the outer end of the catalytic heater 36 and connected to the battery 30, the other electrode being defined by the metallic screen 46 also connected to the battery 30; when energized, both electrodes are operative to discharge an ignition spark for initiating the combustion of the vaporized fuel. The aperture 52, although not necessary, is preferred since it aids in efficient ignition.

The hair dryer 10 further includes a manually operated control device 58 mounted in the handle portion 24 and actuated by a single manually operable actuation member 60, for controlling the amount of current applied to the motor 26 and proportionally adjusting the flow of fuel to the catalytic heater 36 to thereby regulate the temperature of the heated air in relation to the amount of air flow exhausted through the nozzle 22. As shown in FIG. 3, the control device 58 comprises a rheostat 62 connected intermediate the motor 26 and the battery 30 via the electrical wire 64 (see FIG. 2) for varying the amount of current applied to the motor 26 and a valvel 66 arranged in the conduit 38 for varying the flow of fuel to the catalytic heater 36. The actuator member 60 which is operatively connected to both the rheostat 62 and valve 66 is continuously movable along a rectilinear path between a lower limit position shown in broken line and an upper limit position whereby to increase the amount of current applied to the motor 26 when the actuator member 60 is moved in a direction toward the upper limit position or to decrease the amount of current when the actuator member 60 is moved in a direction toward the lower limit position while correspondingly increasing or decreasing the flow of fuel to the catalytic heater 36 to thereby provide heated air having a substantially constant temperature independently of the amount of air flow exhausted through the nozzle 22.

As shown in FIGS. 3–5, the rheostat 62 comprises an elongated resistor element 68 and an electrically conductive sweeping arm 70 in frictional sliding engagement with the resistor element 68 for sweeping same, the arm 70 being fixedly connected to a shaft 72 which is rotatably mounted to a pair of plate members 74 and 76 for permitting the arm 70 to sweep the resistor element 68 when the shaft 72 is rotated. The actuator member 60 is connected to the shaft 72 by means of a pin element 78 fixed to the actuator member 60 and extending through a rectilinear slot 80 formed in the plate member 74, and a lever 82 fixed at one end to the shaft 72 and formed with a longitudinally extending slot 84 receiving the free end 86 of the pin element 78. The free end 86 of the pin element 78 engages the slot 84 for sliding movement therealong such that displacement of the actuator member 60 causes the free end 86 to move along the slot 84 and the lever 82 to pivotally move and thereby rotate the shaft 72, as best shown in FIG. 4. Such a pin and lever connection thus converts the translational movement of the actuator member 60 into a rotational movement for rotating the shaft 72.

The valve 66, on the other hand, comprises a valve body 88 having a fuel passageway 90 formed therein and a valve stem 92 also formed with a fuel passageway 90', the valve stem 92 being movable in the valve body 88 and biased by the coil spring 94, as shown in FIG. 6. A cam disk 96 is fixedly mounted to the shaft 72 and frictionally engages the stem 92 for moving same when the shaft 72 is rotated in response to a displacement of the actuator member 60 so as to adjustably restrict the fuel passageway 90,90' and thereby vary the flow of fuel to the catalytic heater 36 via the conduit 38.

FIG. 7 schematically illustrates the circuit used for varying the amount of current applied to the motor 26 by means of the rheostat 62. As shown, the rheostat 62 is also used for controlling the discharge of an ignition spark between the metallic screen 48 of the catalytic heater and the electrode 56. To this end, the battery 30 is connected to the electrode 56 via the rheostat 62 and to the metallic screen 48 via an amplifier 98 for increasing the voltage so as to provide the necessary ignition spark. The resistor element 68 of the rheostat 62 has an end portion 100 which is electrically insulated from the remainder thereof by an insulating portion 102 and which corresponds to the upper limit position of the actuator member 60. The end portion 100 of the resistor element 68 is connected to the electrode 56 such that when the actuator member 60 is at its upper limit position the circuit between the metallic screen 48 and electrode 56 is closed to discharge an ignition spark therebetween. At this position, the valve 66 is also fully opened to permit maximum flow of fuel to the catalytic heater 36. As shown, the arm 70 of the rheostat 62 is biased by a spring 104 to move off the end portion 100 of the resistor element 68 and to return to a position on the resistor element 68 corresponding to substantially maximum fan speed and maximum flow of fuel to the catalytic heater 36.

Thus, the hair dryer 10 can be simply operated by first moving the actuator member 60 to its upper limit position so as to discharge an ignition spark between the metallic screen 48 and the electrode 56 for initiating the combustion of the fuel, and then releasing the actuator member 60 so that it returns to a position adjacent the upper limit position and corresponding to substantially maximum fan speed and maximum flow of fuel to the catalytic heater 36. Since the hair dryer 10 is adapted to provide heated air having a substantially constant temperature independently of the amount of air flow exhausted through the nozzle 22, the flow rate of heated air can thereafter be varied as desired by simply moving the actuator member 60 between its lower and upper limit positions.

The hair dryer 10 can be conveniently recharged with electricity and refilled with fuel by means of a combined electric and fuel recharging unit 12 illustrated in FIG. 1. As shown, the recharging unit 12 comprises a frame 106 for supporting the dryer 10 in an upright position. The support frame 106 which can be advantageously mounted to a wall 108 by means of screws 110 is formed at its upper end with a vertically extending groove 112 having a T-shaped cross-section for receiving a corresponding flanged rib 114 provided rearwardly of the pressure vessel 42 of the dryer, as best shown in FIGS. 8 and 9. The provision of such a rib and groove enables the dryer 10 to be retained in the upright position while allowing free vertical displacement thereof. As shown in FIG. 9, the groove 112 flares upwardly whereas the rib 114 tapers downwardly at its lower end in order to permit easy insertion of the rib into the groove.

The recharging unit 12 further includes a clip member 116 for holding a fuel container 118 having at the upper end thereof a fuel discharge valve 120 in an upright position with the fuel discharge valve 120 positioned in alignment with the refill valve 122 provided in the bottom wall of the pressure vessel 42 so as to permit the stem 124 of the fuel discharge valve 120 to extend through the orifice 126 of the refill valve 122 when both valves are engaged with one another. The fuel container 118 is of the type having an inner tube 128 connected to the fuel discharge valve 120 and extending to the bottom of the container for allowing transfer of liquid fuel from the container into the reservoir 40 of the pressure vessel 42. An electrical female plug 130 is movably mounted in the base of the support frame 106 for limited vertical displacement between upper and lower positions, the electrical female plug 130 being connectable to an AC household power source by means of the electrical wire 132 and engageable with an electrical male plug 134 which is housed in the handle portion 24 of the dryer and connected to the AC-DC converter/transformer 34. The electrical female plug 130 is formed with a shoulder 136 for engaging the bottom surface 138 of the handle portion 24 and is upwardly biased by a coil spring 140 to the upper position.

The hair dryer 10 can thus be conveniently recharged with electricity and refilled with fuel by downwardly displacing the dryer 10 to a recharge and refill position shown in broken line to cause electrical connection between the electrical female and male plugs 130, 134 and engagement of the fuel discharge valve 120 with the refill valve 122 and by maintaining the dryer 10 at the recharge and refill position against the upward force exerted by the spring 140 for a period of time sufficient to allow the reservoir 40 of the dryer to be refilled with fuel 44. Upon release of the dryer 10, the electrical female plug 130 is upwardly moved by the spring 140 to its upper position to upwardly displace the dryer and thereby cause disengagement of the fuel discharge valve 120 and refill valve 122 from one another while maintaining the electrical connection between the electrical female and male plugs 130, 134. In this manner, the battery 30 is maintained charged while accidental leakage between the refill valve and fuel discharge valve, which otherwise could occur if the valves remained engaged, is prevented.

I claim:

1. A cordless hand held hot air hair dryer comprising:

nozzle means for exhausting air;

a heating chamber disposed proximate said nozzle means;

fuel supply means for storing a vaporizable fuel in a liquid state;

catalytic heating means in fluid flow communication with said fuel supply means and including a catalyst member disposed within said heating chamber for combusting vaporized fuel supplied from said fuel supply means;

battery-powered motor means;

fan means driven by said motor means for passing air through said heating chamber so as to contact said catalyst member, to thereby heat the air prior to exhausting through said nozzle means; and manually operated control means for controlling the amount of current applied to said motor means and proportionally adjusting the flow of fuel to said heating means to thereby regulate the temperature of said heated air in relation to the amount of air flow exhausted through said nozzle means.

2. A dryer as claimed in claim 1, further including ignition means mounted proximate said catalyst member for initiating the combustion of said vaporized fuel.

3. A dryer as claimed in claim 1, wherein said motor means is powered by rechargeable battery means connected thereto.

4. A dryer as claimed in claim 3, further including AC-DC converter/transformer means coupled to said battery means for recharging same.

5. A dryer as claimed in claim 3, wherein a conduit means interconnects said fuel supply means with said heating means, and wherein said control means include valve means in said conduit means for varying the flow of fuel to said heating means and variable resistor means connected intermediate said battery means and said motor means for varying the amount of current applied to said motor means.

6. A dryer as claimed in claim 5, wherein said control means further include a single manually operable actuator member operatively connected to both said valve means and said variable resistor means for actuating same.

7. A dryer as claimed in claim 6, wherein said actuator member is continuously movable along a rectilinear path between first and second limit positions whereby to increase the amount of current applied to said motor means when said actuator member is moved in a direction toward said second limit position or to decrease said amount of current when said actuator member is moved in a direction toward said first limit position while correspondingly increasing or decreasing the flow of fuel to said heating means to thereby provide heated air having a substantially constant temperature independently of the amount of air flow exhausted through said nozzle means.

8. A dryer as claimed in claim 7, wherein said variable resistor means comprises a rheostat having an elongated resistor element and an electrically conductivie sweeping arm in frictional sliding engagement with said resistor element for sweeping same, said arm being fixedly connected to a rotatably mounted shaft for permitting said arm to sweep said resistor element when said shaft is rotated, and wherein said actuator member is connected to said shaft by connecting means adapted to convert the translational movement of said actuator member into a rotational movement for rotating said shaft.

9. A dryer as claimed in claim 8, wherein said valve means comprise a valve body having a fuel passageway formed therein and a valve stem movable in said valve body to adjustably restrict said fuel passageway, and wherein a cam disk is fixedly mounted to said shaft and frictionally engages said stem for moving same when said shaft is rotated in response to a displacement of said actuator member.

10. A dryer as claimed in claim 8, wherein said connecting means comprise a lever formed with a longitudinally extending slot and having one end fixedly connected to said shaft, and a pin element having one end fixed to said actuator member and the other end engaging said slot for sliding movement therealong, whereby displacement of said actuator member causes said other end of said pin to move along said slot and said lever to pivotally move and thereby rotate said shaft.

11. A dryer as claimed in claim 8, further including electrical ignition means mounted proximate said catalyst member and comprising electrode means adapted to discharge an ignition spark for initiating the combustion of said vaporized fuel.

12. A dryer as claimed in claim 11, wherein said battery means is connected to said electrode means via amplifier means for energizing said electrode means to discharge said ignition spark.

13. A dryer as claimed in claim 12, wherein said catalyst member has a cylindrical configuration and is provided with an outer metallic screen supporting said catalyst member inside said heating chamber with one end of said catalyst member adjacent said nozzle means, and wherein said electrode means comprise a pair of electrode members of opposite polarity, one of said electrode members being disposed adjacent said one end of said catalyst member and said metallic screen being connected to said battery means whereby to define the other electrode member.

14. A dryer as claimed in claim 13, wherein said battery means is connected to said one electrode member via said rheostat and to said metallic screen via said amplifier means whereby to permit said ignition means to be operated by said actuator member.

15. A dryer as claimed in claim 14, wherein the resistor element of said rheostat has an end portion electrically insulated from the remainder thereof and corresponding to said second limit position of said actuator member, said end portion of said resistor element being connected to said one electrode member such that when said actuator member is at said second limit position said electrode members are energized to discharge said ignition spark with said valve means being fully opened to permit maximum flow of fuel to said heating means.

16. A dryer as claimed in claim 15, wherein said arm of said rheostat is biased by spring means to move off said end portion of said resistor element and to return to a position on said resistor element corresponding to substantially maximum fan speed and maximum flow of fuel to said heating means.

17. A dryer as claimed in claim 4, comprising a housing having a central portion in which said motor means and fan means are mounted, a tubular portion extending forwardly of said central portion and defining said heating chamber with said nozzle means being provided at a free end of said tubular portion, and a handle portion depending from said central portion in which said control means battery means and AC-DC converter/transformer means are mounted, and wherein said fuel supply means comprises a pressure vessel arranged rearwardly of said central portion and defining a reservoir for containing said fuel, said pressure vessel having a bottom wall provided with a refill valve for refilling said reservoir with said fuel.

18. A combined electric and fuel recharging unit for use in recharging a dryer as claimed in claim 17 with electricity and refilling same with fuel, comprising means for supporting and retaining said dryer in an upright position while allowing free vertical displacement thereof, means for holding a container of said fuel having at an upper end thereof a fuel discharge valve in an upright position with said fuel discharge valve positioned in alignment with said refill valve of said dryer, electrical female plug means engageable with electrical male plug means housed in said handle portion of said dryer and connected to said AC-DC converter/transformer means for supplying same with electricity, said electrical female plug means being mounted for limited vertical displacement thereof between upper and lower positions, and spring means upwardly biasing said electrical female plug means to said upper position, whereby said dryer is recharged with electricity and refilled with fuel by downwardly displacing said dryer to a recharge and refill position causing electrical connection between said electrical male and female plug means and engagement of said refill valve with said fuel discharge valve and by maintaining said dryer at said recharge and refill position against the upward force exerted by said spring means for a period of time sufficient to allow the reservoir of said dryer to be refilled with said fuel, and where, upon release of said dryer, said electrical female plug means is moved upwardly by said spring means from said lower position to said upper position to upwardly displace said dryer and thereby cause disengagement of said refill valve and said fuel discharge valve from one another while maintaining said electrical connection between said electrical male and female plug means.

* * * * *